US008631883B2

(12) United States Patent
Dourfaye

(10) Patent No.: US 8,631,883 B2
(45) Date of Patent: Jan. 21, 2014

(54) SECTORIAL FORCE BALANCING OF DRILL BITS

(75) Inventor: Alfazazi Dourfaye, Paris (FR)

(73) Assignee: Varel International Ind., L.P., Carrollton, TX (US)

( * ) Notice: Subject to any disclaimer, the term of this patent is extended or adjusted under 35 U.S.C. 154(b) by 819 days.

(21) Appl. No.: 12/399,478

(22) Filed: Mar. 6, 2009

(65) Prior Publication Data

US 2009/0223721 A1 Sep. 10, 2009

Related U.S. Application Data

(60) Provisional application No. 61/034,283, filed on Mar. 6, 2008.

(51) Int. Cl.
*E21B 4/00* (2006.01)

(52) U.S. Cl.
USPC ..... 175/293; 175/397; 175/398

(58) Field of Classification Search
USPC ..... 175/293, 385, 391, 397, 399, 408
See application file for complete search history.

(56) References Cited

U.S. PATENT DOCUMENTS

| | | | | |
|---|---|---|---|---|
| 4,982,802 | A * | 1/1991 | Warren et al. | 175/57 |
| 5,010,789 | A | 4/1991 | Brett et al. | |
| 5,456,141 | A | 10/1995 | Ho | 76/108.2 |
| 6,269,893 | B1 | 8/2001 | Beaton et al. | 175/391 |
| 6,474,425 | B1 * | 11/2002 | Truax et al. | 175/398 |
| 6,659,207 | B2 * | 12/2003 | Hoffmaster et al. | 175/391 |
| 2010/0270077 | A1 * | 10/2010 | Huynh et al. | 175/57 |

OTHER PUBLICATIONS

T.M. Warren and A. Sinor, *Drag-Bit Performance Modeling*, SPE Drilling Engineering, Jun. 1989, 119-127, Society of Petroleum Engineers.

* cited by examiner

*Primary Examiner* — Jennifer H Gay
*Assistant Examiner* — Elizabeth Gitlin
(74) *Attorney, Agent, or Firm* — King & Spalding LLP

(57) ABSTRACT

A sectorial force balanced drill bit, including conventional and bi-center drill bits, having the true center of rotation the same as, or about the same as, the bit mass axis. The bit mass axis is a longitudinal axis located off-center to the geometric axis of the bit and comprises the center of mass point. Additionally, a method for sectorially force balancing drill bits is provided. The method includes dividing the drill bit into one or more sections, calculating the magnitude and direction of the resultant radial imbalance force for the cutters of each section, adjusting the cutters and/or blades until the magnitude of the resultant radial imbalance force is about the same for each section and the direction of the resultant radial imbalance force for each section is about $2\pi/n$, where n is the number of sections, from the adjacent section.

12 Claims, 5 Drawing Sheets

SECTORIAL FORCE BALANCING OF DRILL BITS

CROSS-REFERENCE TO RELATED APPLICATIONS

This application claims the benefit of U.S. Provisional Patent Application No. 61/034,283, entitled "Sectorial Force Balancing of Drill Bits," filed Mar. 6, 2008, the entirety of which is incorporated by reference herein.

BACKGROUND OF THE INVENTION

This invention relates generally to drill bits used to drill boreholes in subterranean formations and, more particularly, to a method and apparatus for balancing the drill bits.

In the exploration of oil, gas and geothermal energy, drilling operations are used to create boreholes in the earth. One type of drilling operation includes rotary drilling. According to rotary drilling, the borehole is created by rotating a tubular drill string which has a drill bit coupled to one end. As the drill bit rotates and deepens the borehole, additional drill strings are coupled to the end that does not have the drill bit so that the drill bit may further deepen the borehole. As the drill bit rotates and cuts through the formation, the drill bit becomes hot and creates debris in the form of rock cuttings. A drilling fluid may be pumped through the center of the hollow drill string so that the drill bit may be cooled and lubricated and the debris may be carried away. The drilling fluid travels through the drill string and exits the drill bit at increased velocity through one or more nozzles on the drill bit's outer surface. The drilling fluid then returns to the surface via an annular space which is created between the inner surface of the borehole and the outer surface of the drill string.

One type of bit used for rotary drilling is a drag bit or a fixed cutter bit. These drag bits have a plurality of blades that have a plurality of cutters attached to each of the blades. As the drag bit is rotated, the cutters scrape against the bottom and sides of the borehole to cut away rock. As the rate of penetration of the drill increases, the effective life of these drag bits are substantially decreased because the cutters become cracked and occasionally are violently torn from the blade.

A substantial portion of these destructive forces are caused by radial imbalance forces, which are the forces occurring perpendicular to the longitudinal axis of the drill bit. These radial imbalance forces cause the drill bit to rotate about a center offset from the geometric center of the bit body, or geometric bit axis, in such a way that the drill bit tends to backwards whirl about the borehole or to enlarge the borehole from the nominal diameter. The true rotational axis of the drill bit is most likely not the geometric axis of the drill bit. This backwards whirl causes the center of rotation to change dynamically. Thus, the cutters become exposed to greatly increased impact loads or higher change in the cutter loading during one revolution of the bit, thereby destroying the cutters.

The use of blade asymmetry in full hole PDC drill bits is common as an anti-whirl configuration. Blade asymmetry in almost all cases will shift the mass center of the bit off of the geometric center of the bit. The mass center shifting off of the geometric center of the bit results in additional imbalance forces on the drill bit and also contributes to destroying the cutters.

Time and money is consumed when cutters are destroyed. The drilling process stops, the drill string must be removed, a new drill bit must be attached to the drill string, and the time period to obtain the profitable oil, gas, and/or geothermal energy is delayed. Thus, manufactures attempt to force balance the bit so that the rotational axis of the bit is the same as the drill string center, or geometric bit axis. The force is typically balanced by setting the cutters so that the resultant radial imbalance force is zero, which is the sum of all centrifugal forces and the sum of all the centripetal forces, according to the best case scenario. Additionally, the imbalance ratio, which is the ratio of the resultant radial imbalance force to the weight-on-bit (WOB) force, should be within a certain desired value according to manufacturer criteria. According to some manufacturers, the imbalance ratio should be 10% or less. Current force balancing techniques do not take into account any shift in the mass center of the bit off of the geometric center.

An additional concern arises when attempting to force balance bi-center bits, which have a reamer section and a pilot section. The pilot section is usually smaller and is coupled to the reamer section. The pilot section has its pilot section geometric center, while the reamer section has its reamer section geometric center. Since the bi-center bit typically has two centers, the radial imbalance forces are balanced on the pilot section geometric center, not both of them. Despite these force balancing efforts, the life of the cutters may be further increased by using more innovative balancing techniques.

U.S. Pat. No. 5,010,789 (the "'789 Patent"), issued to Brett et al. on Apr. 30, 1991, discloses a method of making imbalanced compensated drill bits. The teachings disclosed in the '789 Patent are incorporated by reference herein.

In view of the foregoing discussion, need is apparent in the art for improving the drill bits so that the life of the cutters are increased. Additionally, a need exists for improving methods for balancing the drill bit. Furthermore, a need exists for improved force balancing methods that account for the shift in the mass center of the bit. Moreover, there exists a need to produce an improved forced balanced bit that has blade asymmetry. A technology addressing one or more such needs, or some other related shortcoming in the field, would benefit down hole drilling, for example creating boreholes more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

Figure 1:
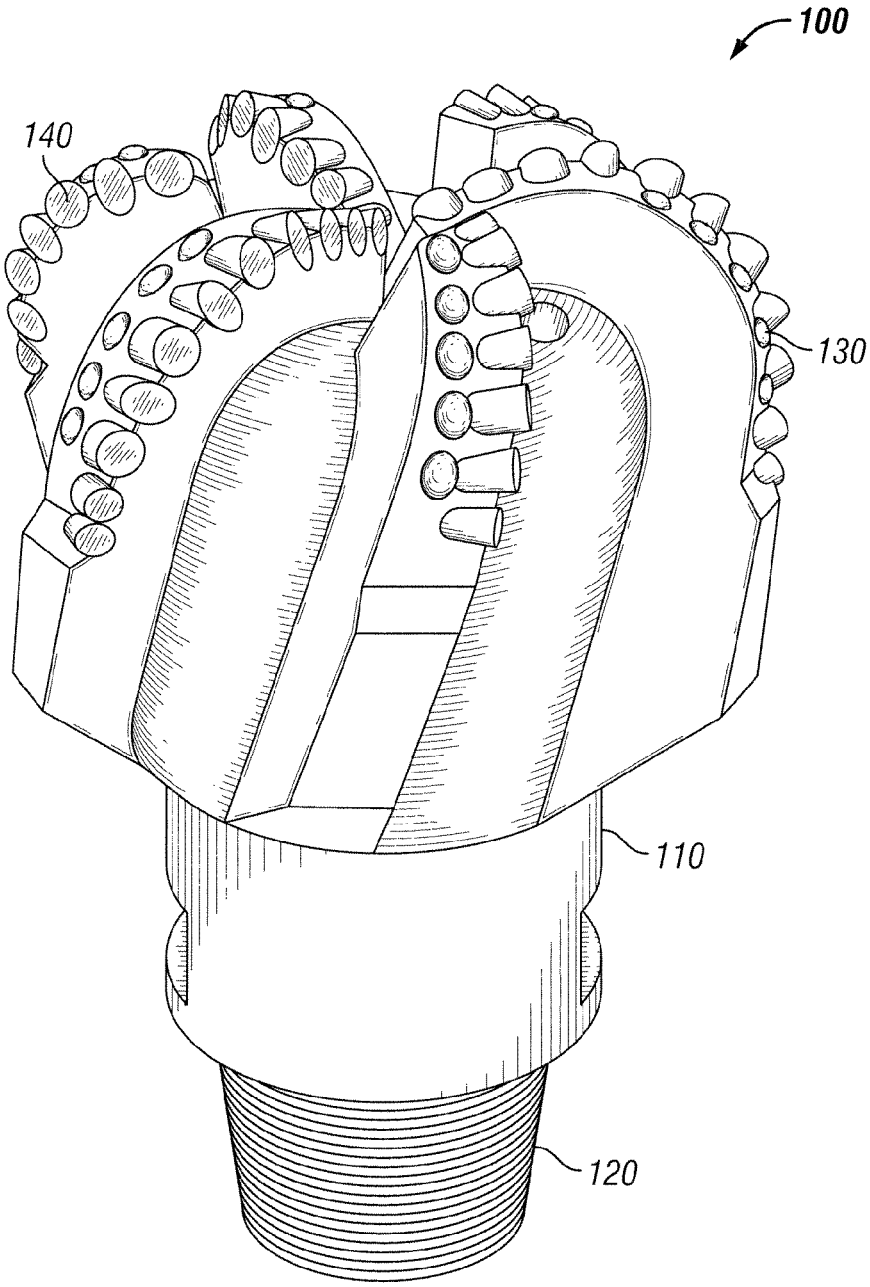
FIG. 1 shows an oblique view of a sectorial force balanced conventional bit in accordance with an exemplary embodiment.

FIG. 1 shows an oblique view of a sectorial force balanced conventional bit 100 in accordance with an exemplary embodiment. The sectorial force balanced conventional bit 100, or drill bit, includes a bit body 110 having a threaded connection at one end 120 and a plurality of blades 130 extending from the other end of the bit body 110. The plurality of blades 130 form the cutting surface of the sectorial force balanced conventional bit 100. These plurality of blades 130 may be coupled to the bit body 110 or may be integrally formed into the bit body 110. A plurality of cutters 140 are coupled to each of the blades 130 and extend from the blades to cut through earth formations when the sectorial force balanced conventional bit 100 is rotated during drilling. The cutters 140 deform the earth formation by scraping and shearing.

The threaded connection is shown to be positioned on the exterior surface of the one end 120. This positioning assumes that the sectorial force balanced conventional bit 100 may be coupled to a threaded connection located on the interior surface of a drill string (not shown). However, the threaded connection may alternatively be positioned on the interior surface of the one end 120 if the threaded connection of the drill string (not shown) is positioned on the exterior surface, without departing from the scope and spirit of the exemplary embodiment.

The cutting edge of the plurality of cutters 140 is made from hard cutting elements, such as natural or synthetic diamonds. The cutters made from synthetic diamonds are generally known as polycrystalline diamond compact cutters (PDCs). Other materials, including, but not limited to, cubic boron nitride (CBN) and thermally stable polycrystalline diamond (TSP), may be used for the cutting edge of the plurality of cutters 140.

Figure 2:
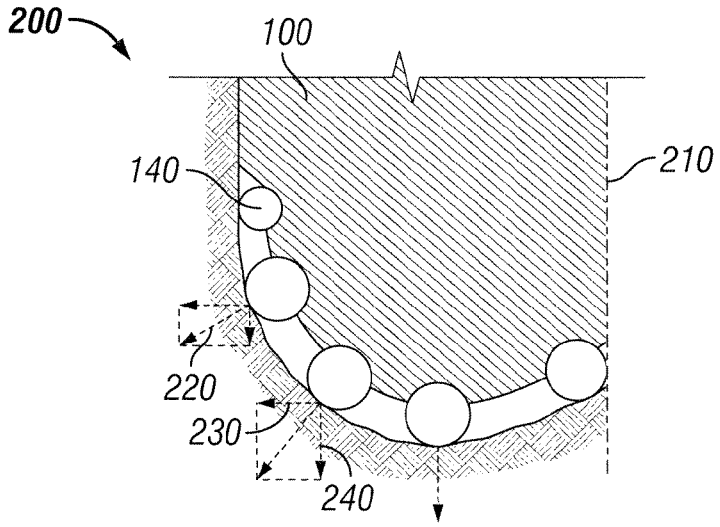
FIG. 2 shows a perspective view of a cutter loading diagram across a drill bit profile in accordance with an exemplary embodiment.

FIG. 2 shows a perspective view of a cutter loading diagram 200 across a drill bit profile in accordance with an exemplary embodiment. For exemplary purposes, FIG. 2 shows the cutters 140 of the sectorial force balanced conventional bit 100 with respect to one side of a bit mass axis 210. The bit mass axis 210 is the longitudinal axis comprising the point at which the sectorial force balanced conventional bit's 100 center of mass is located. This bit mass axis 210 may be located parallel to the sectorial force balanced conventional bit's 100 geometric bit axis (not shown). The geometric bit axis is typically at a different location than the bit mass axis 210. When the sectorial force balanced conventional bit 100 fragments the formation, each cutter 140 exerts a force on the formation. This force may be divided into two components, the drag force (not shown) and the normal force 220. The drag force (not shown) acts parallel, or laterally, to the groove formed by the cutter 140. The drag force is a torsional force responsible for the torque at the sectorial force balanced conventional bit 100. The normal force 220, however, acts perpendicular to the groove formed by the cutter 140.

The normal force 220 may further be viewed as having two components, a radial imbalance force 230 and a weight-on-bit force (WOB) 240, or axial force. The radial imbalance force 230 is exerted in a direction that is perpendicular to the bit mass axis 210, while the weight-on-bit force 240 is exerted in a direction that is parallel to the bit mass axis 210. The radial imbalance forces 230 tend to push the drill bit 100 towards a side of the borehole, which may cause greater increased impact loads on the cutters 140 if the drill bit 100 is not properly balanced. These increased impact loads may destroy the cutters 140. The individual forces 230, 240 exerted from each cutter 140 may be added vectorially and summed into their resultant components. Thus, for a known set of drilling conditions, a resultant WOB force, a resultant drag force, and a resultant radial imbalance force may be calculated for any desired set of cutters 140.

Since the radial imbalance forces 230 and the WOB forces 240 are derived from the normal force 220, the radial imbalance forces 230 are proportional to the WOB forces 240. Thus, the resultant radial imbalance force may be expressed as a percentage of the resultant WOB force. The magnitude of the resultant radial imbalance force relative to the magnitude of the resultant WOB force affects the sectorial force balanced conventional bit's 100 tendency to backwards whirl. Additionally, the direction of the resultant radial imbalance force affects the drill bit's 100 steerability and directional behavior. The ratio of the resultant radial imbalance force relative to the resultant WOB force may be about 10% or less. The sectorial force balanced conventional bit's 100 performance may be enhanced as this ratio decreases.

The ratio may be dependent upon the size of the sectorial force balanced conventional bit 100. For a 6" or smaller bit size, the ratio may be about 10% or less. For a bit size larger than 6" but less than or equal to 12¼", the ratio may be about 5% or less. For a bit size greater than 12¼", the ratio may be about 2.5% or less. Although typical ratio ranges have been provided for a given bit size according to an exemplary embodiment, these ratio ranges may vary outside of the provided range for a given bit size, without departing from the scope and spirit of the exemplary embodiment.

Figure 3:
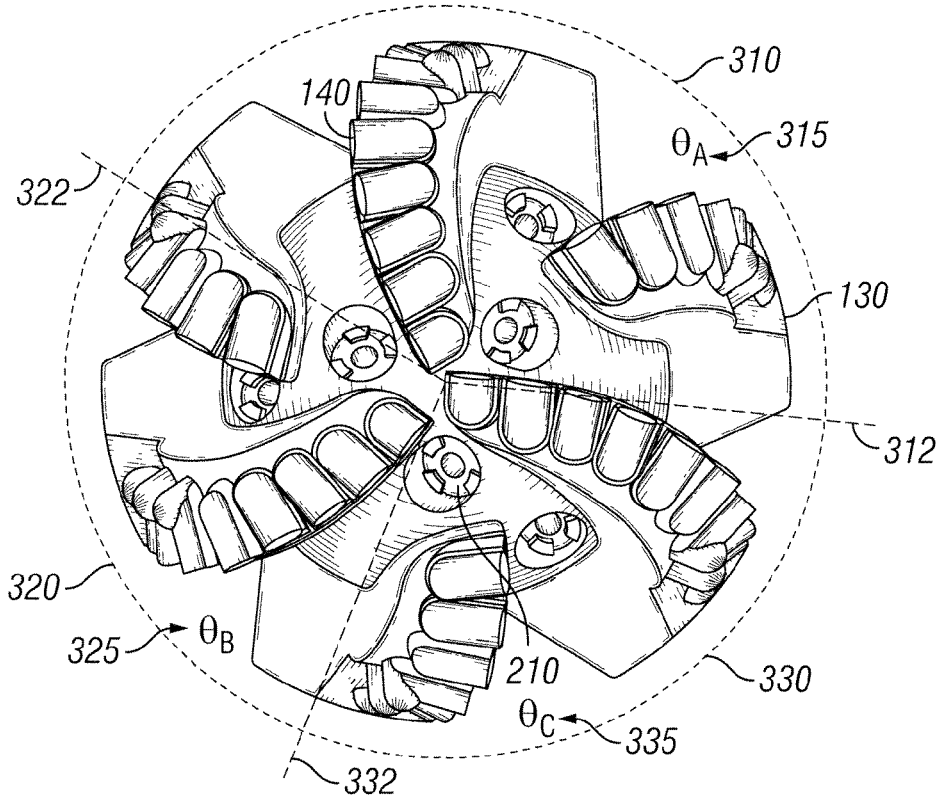
FIG. 3 shows a top view of a sectorial force balanced conventional bit illustrating key parameters for sectorial force balancing in accordance with an exemplary embodiment.

FIG. 3 shows a top view of a sectorial force balanced conventional bit illustrating key parameters for sectorial force balancing in accordance with an exemplary embodiment. The illustrated key parameters include the bit mass axis 210, a theta A ($\theta_A$) 315, a theta B ($\theta_B$) 325, and a theta C ($\theta_C$) 335. Although not physically seen on the cutting surface of the sectorial force balanced conventional bit 100, the cutting surface may be divided into a predetermined number of sections, which may include two or more sections, such that the magnitude of the resultant radial imbalance force is about the same for each section and that the directions of the resultant radial imbalance force is $2\pi/n$, or 360°/n, from each other, where n is the number of predetermined sections. The sections are formed by extending two or more planar rays from the bit mass axis 210 towards the outer circumference of the sectorial force balanced conventional bit 100. Each section comprises one or more blades 130 or a portion of the blade. Additionally, the sections may be either symmetrical or asymmetrical.

According to an exemplary embodiment shown in FIG. 3, the sectorial force balanced conventional bit 100 is divided into three sections 310, 320, 330. The three sections 310, 320, 330 are created by extending three planar rays 312, 322, 332 from the bit mass axis 210 towards the outer circumference of the sectorial force balanced conventional bit 100. Section one 310 is represented by the area bounded between planar ray one 312 and planar ray two 322, wherein theta A ($\theta_A$) 315 is the angle of section one 310 and defined by the angle between the planar ray one 312 and the planar ray two 322. Section two 320 is represented by the area bounded between planar ray two 322 and planar ray three 332, wherein theta B ($\theta_B$) 325 is the angle of section two 320 and defined by the angle between the planar ray two 322 and the planar ray three 332. Section three 330 is represented by the area bounded between planar ray three 332 and planar ray one 312, wherein theta C ($\theta_C$) 335 is the angle of section three 330 and defined by the angle between the planar ray three 332 and the planar ray one 312. The three sections are shown to be asymmetrical to each other.

During drilling operations, the section one 310 cutters 140 exert a resultant radial imbalance force magnitude about equal to the resultant radial imbalance force magnitude of the section two 320 cutters 140. Additionally, the section three 330 cutters 140 also exert about the same resultant radial imbalance force magnitude as the cutters 140 for section one 310 and section two 320. The direction between the resultant radial imbalance force for each of the sections 310, 320, 330 is $2\pi/3$, or 120°, from each other. Since the bit mass axis 210 is the vertex of sections 310, 320, 330, the magnitudes of the resultant radial imbalance force for each section 310, 320, 330 is about equal, and the directions of the resultant radial imbalance force for each section 310, 320, 330 is $2\pi/n$, or 360°/n, from each other, where n is the number of sections, then the sum of all resultant imbalance forces converges to about the bit mass axis 210. Thus, the true center of rotation axis is the same as, or is about the same as, the bit mass axis 210. When the true rotational axis becomes the bit mass axis 210, the longevity of the cutters 140 may be improved.

Although this exemplary embodiment shows three sections, 310, 320, 330, greater or fewer sections may be made on the cutting surface without departing from the scope and spirit of the exemplary embodiment.

Figure 4:
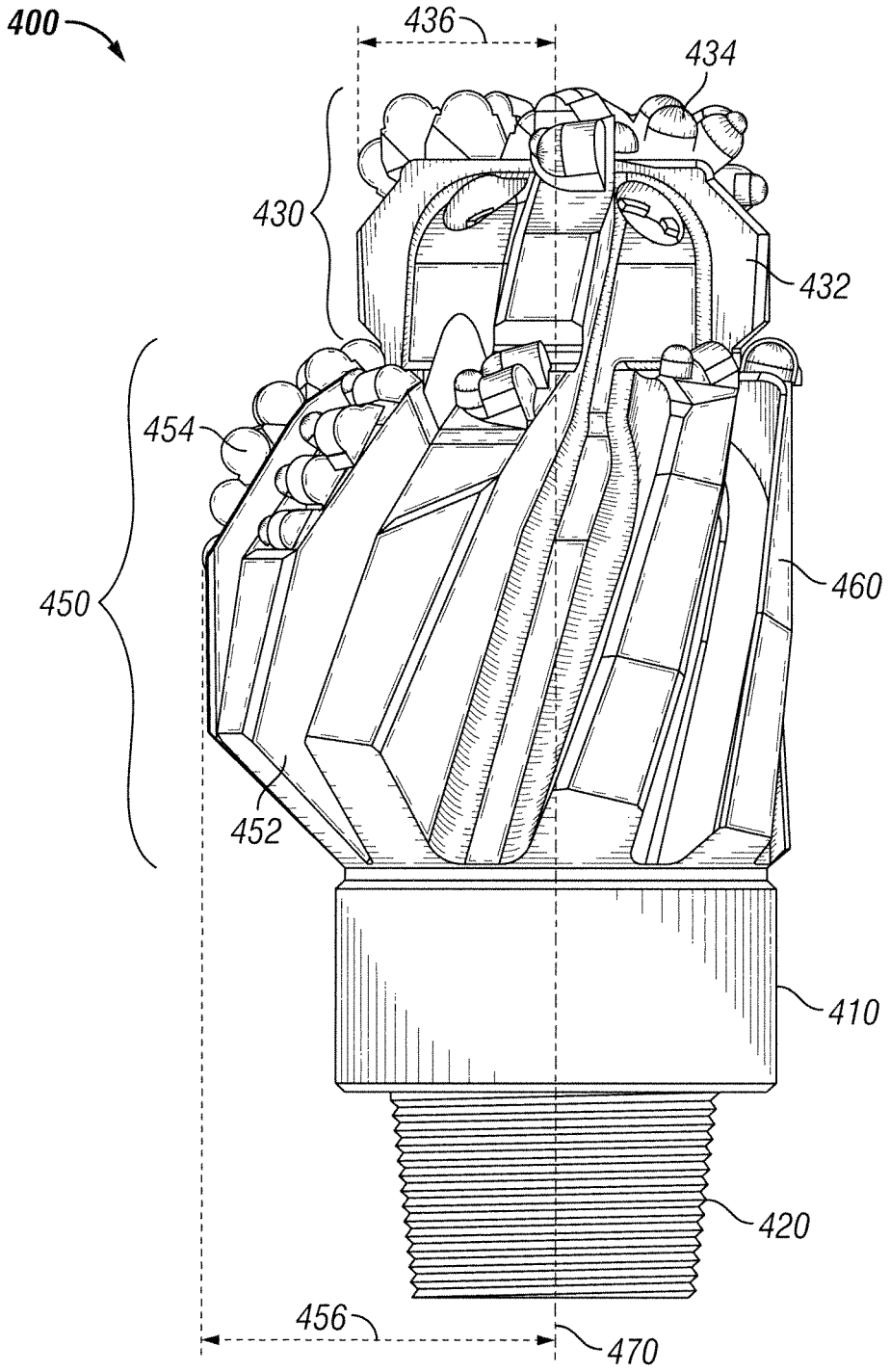
FIG. 4 shows an oblique view of a sectorial force balanced bi-center drill bit in accordance with an exemplary embodiment.

FIG. 4 shows an oblique view of a sectorial force balanced bi-center drill bit in accordance with an exemplary embodiment. The sectorial force balanced bi-center drill bit 400 includes a bit body 410 having a threaded connection at one end 420, a pilot section 430 located at the other end of the bit body 410, and a reaming section 450 positioned on the bit body 410 and axially spaced apart from the pilot section 430. The reaming section 450 and the pilot section 430 may be separate structures or a single integral structure.

The threaded connection is shown to be positioned on the exterior surface of the one end 420. This positioning assumes that the sectorial force balanced bi-center drill bit 400 may be coupled to a threaded connection located on the interior surface of a drill string (not shown). However, the threaded connection may alternatively be positioned on the interior surface of the one end 420 if the threaded connection of the drill string (not shown) is positioned on the exterior surface, without departing from the scope and spirit of the exemplary embodiment.

The pilot section 430 may include a plurality of pilot blades 432 forming the cutting surface of the pilot section 430. These plurality of pilot blades 432 may be coupled to the bit body 410 or may be integrally formed into the bit body 410. Each of the pilot blades 432 typically extend about the same distance laterally from the longitudinal axis 470, which may extend through the drill string center. This distance represents the pilot section drilling radius, $R_P$ 436. Thus, when the sectorial force balanced bi-center drill bit 400 rotates about the longitudinal axis 470, the pilot section 430 drilling diameter is equal to 2 $R_P$. Additionally, each pilot blade 432 may include a plurality of pilot cutters 434. The plurality of pilot cutters 434 are coupled to each of the pilot blades 432 and extend from the pilot blades 432 to cut through earth formations when the sectorial force balanced bi-center drill bit 400 is rotated during drilling. The pilot cutters 434 deform the earth formation by scraping and shearing.

The cutting edge of the plurality of pilot cutters 434 is made from hard cutting elements, such as natural or synthetic diamonds. The cutters made from synthetic diamonds are generally known as polycrystalline diamond compact cutters (PDCs). Other materials, including, but not limited to, cubic boron nitride (CBN) and thermally stable polycrystalline diamond (TSP), may be used for the cutting edge of the plurality of pilot cutters 434.

The reaming section 450 may include a plurality of reaming blades 452 forming the cutting surface of the reaming section 450. These plurality of reaming blades 452 may be coupled to the bit body 410 or may be integrally formed into the bit body 410. The reaming blades 452 typically extend different distances laterally from the longitudinal axis 470. However, there may be some reaming blades 452 that extend the same lateral distance from the longitudinal axis 470 as another reaming blade 452. At least one of the reaming blades 452 extends the maximum lateral distance from the longitudinal axis 470. This maximum lateral distance represents the reaming section drilling radius, $R_R$ 456. Thus, when the sectorial force balanced bi-center drill bit 400 rotates about the longitudinal axis 470, the reaming section 450 drilling diameter is equal to 2 $R_R$. Additionally, each reaming blade 452 may include a plurality of reaming cutters 454. The plurality of reaming cutters 454 are coupled to each of the reaming blades 452 and extend from the reaming blades 452 to cut through earth formations when the sectorial force balanced bi-center drill bit 400 is rotated during drilling. The reaming cutters 434 deform the earth formation by scraping and shearing.

The cutting edge of the plurality of reaming cutters 454 is made from hard cutting elements, such as natural or synthetic diamonds. The cutters made from synthetic diamonds are generally known as polycrystalline diamond compact cutters (PDCs). Other materials, including, but not limited to, cubic boron nitride (CBN) and thermally stable polycrystalline diamond (TSP), may be used for the cutting edge of the plurality of reaming cutters 454.

Although the pilot blades 432 and the reaming blades 452 have been described as being distinct blades, there may exist at least one blade which is not a distinct blade without departing from the scope and spirit of the exemplary embodiment. In other words, there may be at least one blade which travels from the lower end of the reaming section 450 to the upper end of the pilot section 430.

Referring now to FIG. 4 and FIG. 2, the pilot cutters 434 and the reaming cutters 454 of the sectorial force balanced bi-center drill bit 400 also exert a force on the formation during drilling operations. The cutters 140, illustrated in FIG. 2, may also represent the pilot cutters 434 and the reaming cutters 454. As mentioned previously, this exerted force may be divided into two components, the drag force (not shown) and the normal force 220. The drag force (not shown) acts parallel, or laterally, to the groove formed by the cutters 434, 454, while the normal force 220 acts perpendicular to the groove formed by the cutters 434, 454.

Also as described previously, the normal force 220 may further be viewed as having two components, the radial imbalance force 230 and the weight-on-bit force (WOB) 240, or axial force. The radial imbalance forces 230 tend to push the drill bit 100 towards a side of the borehole, which may cause greater increased impact loads on the cutters if the drill bit is not properly balanced. These increased impact loads may destroy the cutters 434, 454. The individual forces exerted from each cutter 434, 454 may be added vectorially and summed into their resultant components. Thus, for a known set of drilling conditions, a resultant WOB force, a resultant drag force, and a resultant radial imbalance force may be calculated for any desired set of cutters 434, 454.

Additionally, the resultant radial imbalance force may be expressed as a percentage of the resultant WOB force. The magnitude of the resultant radial imbalance force relative to the magnitude of the resultant WOB force affects the sectorial force balanced bi-center drill bit's 400 tendency to backwards whirl. Additionally, the direction of the resultant radial imbalance force affects the sectorial force balanced bi-center drill bit's 400 steerability and directional behavior. The ratio of the resultant radial imbalance force relative to the resultant WOB force may be about 10% or less. The sectorial force balanced bi-center drill bit's performance may be enhanced as this ratio decreases.

Figure 5A:
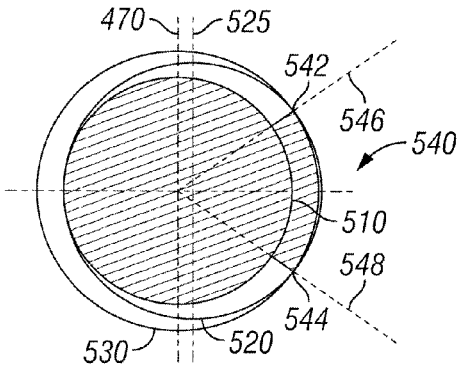
FIGS. 5A-B show a diagram illustrating a reamer contact angle for a sectorial force balanced bi-center drill bit in accordance with an exemplary embodiment.
Figure 5B:
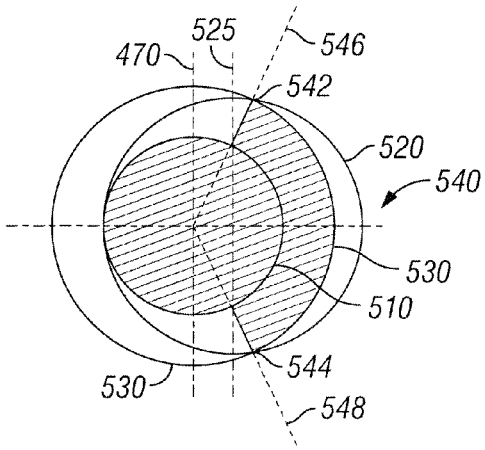

FIGS. 5A-B show a diagram illustrating a reamer contact angle for a sectorial force balanced bi-center drill bit in accordance with an exemplary embodiment. FIG. 5A shows a maximum tool diameter 510, a pass through diameter 520, a drilling diameter 530, and a reamer contact angle 540 for an exemplary configuration of a sectorial force balanced bi-center drill bit. FIG. 5B shows the maximum tool diameter 510, the pass through diameter 520, the drilling diameter 530, and the reamer contact angle 540 for another exemplary configuration of a sectorial force balanced bi-center drill bit.

The maximum tool diameter 510 is the diameter measured from the longitudinal axis 470 to the offside 460 (FIG. 4) of the reaming section 450 (FIG. 4). Thus, the maximum tool diameter 510 defines the largest permissible diameter of a tool that may be positioned above or below the reamer section 450 (FIG. 4).

The pass through diameter 520 is determined by the rotation of the sectorial force balanced bi-center drill bit 400 about a pass through axis 525. The pass through axis 525 is the axis about which the sectorial force balanced bi-center drill bit 400 is rotated when in casing and extends through the casing center.

The drilling diameter 530 is determined by the rotation of the sectorial force balanced bi-center drill bit 400 about the longitudinal axis 470. The drilling diameter 530 intersects the pass through diameter 520 at a first contact point 542 and a second contact point 544. Once the first and second contact points are determined 542, 544, the reamer contact angle 540 is defined by extending a first contact ray 546 from the longitudinal axis 470 to the first contact point 542 and extending a second contact ray 548 from the longitudinal axis 470 to the second contact point 544. The reamer contact angle 540 is the angle formed between the first contact ray 546 and the second contact ray 548.

Figure 6:
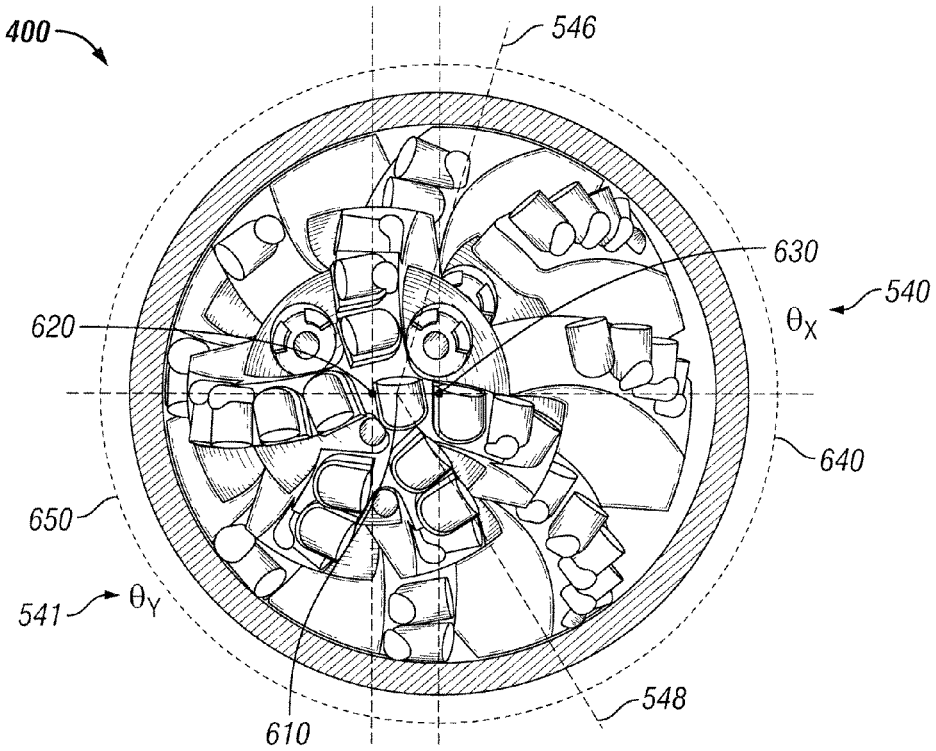
FIG. 6 shows a top view of a sectorial force balanced bi-center drill bit illustrating key parameters for sectorial force balancing in accordance with an exemplary embodiment.

FIG. 6 shows a top view of a sectorial force balanced bi-center drill bit illustrating key parameters for sectorial force balancing in accordance with an exemplary embodiment. The illustrated key parameters include the bit mass axis 610, the reamer contact angle, or theta X ($\theta_X$), 540, and theta Y ($\theta_Y$) 541. Additional key parameters include a drill string center 620, which passes through the longitudinal axis 470 (FIGS. 5A-B) and a casing center 630, which passes through the pass through axis 525 (FIGS. 5A-B). Although not physically seen on the cutting surface of the sectorial force balanced bi-center drill bit 400, the cutting surface may be divided into a predetermined number of sections, which may include two or more sections, such that the magnitude of the resultant radial imbalance force is about the same for each section and that the directions of the resultant radial imbalance force is $2\pi/n$, or $360°/n$, from each other, where n is the number of predetermined sections. The sections are formed by extending two or more planar rays from the bit mass axis 610 towards the outer circumference of the sectorial force balanced bi-center bit 400. Each section comprises one or more blades or a portion of the blade. Additionally, the sections may be either symmetrical or asymmetrical. According to some embodiments, one section may include the two planar rays 546, 548 which define the reamer contact angle 540, except now the planar rays originate from the bit mass axis 610, instead of the longitudinal axis 470.

According to an exemplary embodiment shown in FIG. 6, the sectorial force balanced bi-center drill bit 400 is divided into two sections 640, 650. The two sections 640, 650 are created by moving the vertex of two planar rays 546, 548 from the longitudinal axis 470 to the bit mass axis 610. Thus, these planar rays 546, 548 extend from the bit mass axis 610 towards the outer circumference of the sectorial force balanced bi-center drill bit 400. Section one 540 is represented by the area bounded from the first contact planar ray 546 to the second contact planar ray 548 moving in a clockwise direction. Theta X ($\theta_X$), or the reamer contact angle, 540 is the angle of section one 640. Section two 650 is represented by the area bounded from the second contact planar ray 548 to the first contact planar ray 546 moving in a clockwise direction. Theta Y ($\theta_Y$) 541 is the angle of section two 650. Theta Y ($\theta_Y$) may be defined as $2\pi$—reamer contact angle, or 360°—reamer contact angle. The two sections are shown to be asymmetrical to each other.

During drilling operations, the section one 640 cutters 434, 454 exert a resultant radial imbalance force magnitude about equal to the resultant radial imbalance force magnitude of the section two 650 cutters 434, 454. The direction between the resultant radial imbalance force for each of the sections 640, 650 is $\pi$, or 180°, from each other. The sum of all resultant imbalance forces converges to about the bit mass axis 610. Thus, the true center of rotation axis is the same as, or is about the same as, the bit mass axis 610. When the true rotational axis becomes the bit mass axis 610, the longevity of the cutters 140 may be improved.

Although this exemplary embodiment shows two sections, sections one and/or two may be divided into greater sections without departing from the scope and spirit of the exemplary embodiment. The direction between the resultant radial imbalance force for each of the sections is $2\pi/n$, where n is the number of sections. The sum of all resultant imbalance forces converges to about the bit mass axis.

Figure 7:
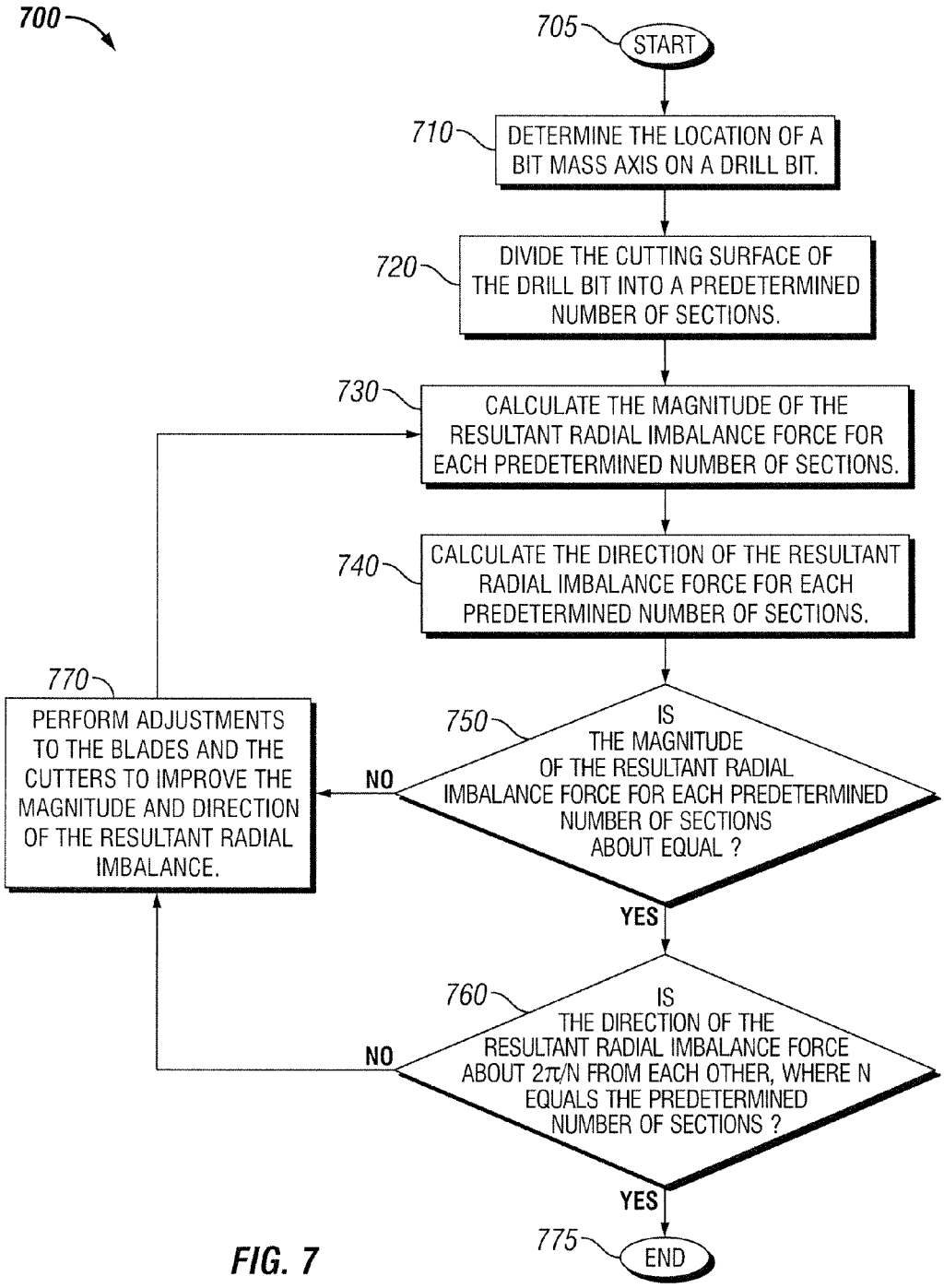
FIG. 7 shows a method for performing sectorial balancing on a drill bit in accordance with an exemplary embodiment.

FIG. 7 shows a method for performing sectorial balancing on a drill bit 700 in accordance with an exemplary embodiment. This method may be performed via a computer, wherein the drill bit operating properties are modeled. Alternatively, actual data may be entered into the computer model to enhance the accuracy of the modeling. The method 700 starts at step 705. Following step 705, the location of the bit mass axis is determined on a drill bit at step 710. The bit mass axis is a longitudinal axis going through the center of mass of the drill bit. The bit mass axis may be located parallel to geometric center axis of the drill bit. For a symmetric or conventional bit, the bit mass axis may be slightly off-center from the drill bit's geometric axis. For a bi-center drill bit, the bit mass axis is further off-center from the drill bit's geometric axis.

After step 710, the cutting surface of the drill bit is divided into a predetermined number of sections at step 720. As described above, the predetermined number of sections for a conventional bit may be divided such that there are at least two or more sections. These sections are created by extending planar rays from the bit mass axis towards the cutting surface of the bit. Each section may include at least one blade, wherein the blades have one or more cutters.

Also as described above, the predetermined number of sections for a bi-center drill bit may be divided upon determining the reamer contact angle. The reamer contact angle may be determined after the contact points where the drilling diameter and the pass through diameter intersect. The sections are created by extending planar rays from the bit mass axis towards the cutting surface of the bit, while maintaining the same reamer contact angle. Each section may include at least one blade, wherein the blades have one or more cutters.

After step 720, the magnitude of the resultant radial imbalance force is calculated for each predetermined number of sections at step 730. As described above, the cutters exert a drag force and a normal force. The normal force may further be viewed as having two components, a radial imbalance force and a weight-on-bit force (WOB), or axial force. The individual forces exerted from each cutter may be added vectorially and summed into their resultant components. Thus, radial imbalance force exerted by each cutter in a sector may be summed into a resultant radial imbalance force, having a quantified magnitude. The magnitude of the resultant radial imbalance force for each section is calculated.

After step 730, the direction of the resultant radial imbalance force is calculated for each predetermined number of sections at step 740. The direction also may be calculated by vectorially adding the radial imbalance force for each cutter in a sector. The direction of the resultant radial imbalance force for each section is calculated.

After step 740, a determination is made at step 750 as to whether the magnitude of the resultant radial imbalance force for each predetermined number of sections is about equal. If the magnitude is about equal, the next step is step 760. If the magnitude is not about equal, the next step is step 770.

At step 760, a determination is made as to whether the direction of the resultant radial imbalance force is about $2\pi/n$ from each other, where n equals the predetermined number of sections. If the direction is about $2\pi/n$ from each other, the method ends at step 775. If the direction is not about $2\pi/n$ from each other, the next step is step 770.

At step 770, adjustments are performed on the blades and/or the cutters to improve the magnitude and direction of the resultant radial imbalance force. These adjustments include, but are not limited to, (1) modifying the number of cutters, (2) modifying the diameter of one or more cutters, (3) modifying the geometric shape of one or more cutters, (4) adding or removing gauge pads, (5) modifying the number of blades, (6) modifying the shape of one or more blades, (7) modifying the distance between one or more blades, (8) altering the side rake, (9) altering the back rake, (10) twisting the cutter such that more or less surface area makes contact with the surface of the borehole, and (11) modifying the weight of one or more cutters. After adjustments are made at step 770, the method proceeds back to step 720.

Upon completion of method 700, the magnitude of the resultant radial imbalance force is about the same for each predetermined section and the direction of the resultant radial imbalance force is about $2\pi/n$ from each other, where n is the number of predetermined sections. Additionally, the total resultant radial imbalance force for all sections converges to about the bit mass axis, thereby properly balancing the bit. The true rotational axis ideally becomes the bit mass axis.

Although the method 700 has been illustrated in certain steps, some of the steps may be performed in a different order without departing from the scope and spirit of the exemplary embodiment. Additionally, some steps may be combined into a single step or divided into multiple steps without departing from the scope and spirit of the exemplary embodiment.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A sectorial force balanced drill bit, comprising:

a bit body;

a plurality of blades extending from one end of the bit body, the plurality of blades forming a cutting surface;

a plurality of cutters couple to one or more of the plurality of blades, each of the plurality of cutters exerting a radial imbalance force;

a geometric longitudinal axis extending centrally through the drill bit; and a longitudinal bit mass axis extending non-centrally through the drill bit and substantially parallel to the geometric longitudinal axis, the longitudinal bit mass axis comprising the center of mass of the drill bit, the longitudinal bit mass axis being a real center of rotation of the drill bit during operation of the drill bit, wherein the plurality of cutters are force balanced about the longitudinal bit mass axis.

2. The sectorial force balanced drill bit of claim 1, wherein the cutting surface comprises two or more sections having a vertex located at the bit mass axis of the drill bit, and wherein the plurality of cutters disposed within each section are oriented to produce a corresponding resultant radial imbalance force within that respective section, each corresponding resultant radial imbalance force being about equal in magnitude, and wherein the corresponding resultant radial imbalance force of each section is balanced about the longitudinal bit mass axis.

3. The sectorial force balanced drill bit of claim 2, wherein the direction of the resultant radial imbalance force of each section is about $2\pi/n$ from the direction of the resultant radial imbalance within the adjacent section, where n is the total number of sections.

4. The sectorial force balanced drill bit of claim 1, wherein the drill bit is a fixed drill bit.

5. The sectorial force balanced drill bit of claim 1, wherein the drill bit is a bi-center drill bit.

6. The sectorial force balanced drill bit of claim 5, wherein the cutting surface comprises at least two sections having a vertex located at the bit mass axis of the drill bit, and wherein the plurality of cutters disposed within each section are oriented to produce a corresponding resultant radial imbalance force within that respective section, each corresponding resultant radial imbalance force being about equal in magnitude, and wherein the corresponding resultant radial imbalance force of each section is balanced about the bit mass axis.

7. The sectorial force balanced drill bit of claim 6, wherein one of the sections defines a reamer contact angle.

8. The sectorial force balanced drill bit of claim 7, wherein a second section is $2\pi/n$ minus the reamer contact angle.

9. The sectorial force balanced drill bit of claim 6, wherein the direction of the resultant radial imbalance force of each section is about $2\pi/n$ from the direction of the resultant radial imbalance within the adjacent section, where n is the total number of sections.

10. The sectorial force balanced drill bit of claim 1, wherein each blade is positioned between two adjacently positioned blades.

11. A sectorial force balanced drill bit, comprising:

a bit body;

a plurality of blades extending from one end of the bit body, the plurality of blades forming at least a portion of a cutting surface;

a plurality of cutters coupled to one or more of the plurality of blades, each of the plurality of cutters exerting a radial imbalance force;

a geometric longitudinal axis extending centrally through the drill bit; and a longitudinal bit mass axis extending non-centrally through the drill bit and substantially parallel to the geometric longitudinal axis, the longitudinal bit mass axis comprising the center of mass of the drill bit, wherein the cutting surface comprises two or more sectors extending outwardly from a vertex positioned on the longitudinal bit mass axis of the drill bit, and wherein the plurality of cutters disposed within each sector are oriented to collectively produce a corresponding resultant radial imbalance force within that respective sector, each corresponding resultant radial imbalance force being about equal in magnitude, and wherein the corresponding resultant radial imbalance force of each section is balanced about the longitudinal bit mass axis.

12. A sectorial force balanced drill bit, comprising:

a bit body;

a plurality of blades extending from one end of the bit body, the plurality of blades forming at least a portion of a cutting surface;

a plurality of cutters coupled to one or more of the plurality of blades, each of the plurality of cutters exerting a radial imbalance force;

a geometric longitudinal axis extending centrally through the drill bit; and a longitudinal bit mass axis extending non-centrally through the drill bit and substantially parallel to the geometric longitudinal axis, the longitudinal bit mass axis comprising the center of mass of the drill bit, wherein the cutting surface comprises two or more sectors extending outwardly from a vertex positioned on the longitudinal bit mass axis of the drill bit, and wherein the plurality of cutters disposed within each sector are oriented to collectively produce a corresponding resultant radial imbalance force within that respective sector, wherein the corresponding resultant radial imbalance force of each section is balanced about the longitudinal bit mass axis, the direction of each resultant radial imbalance force being about $2\pi/n$ from the resultant radial imbalance positioned in the adjacent sector, where n is the total number of sectors.

* * * * *